United States Patent [19]

Kaye

[11] 4,299,435

[45] Nov. 10, 1981

[54] FUSE RECEPTACLE

[75] Inventor: Gordon E. Kaye, Garrison, N.Y.

[73] Assignee: Duracell International Inc., Bethel, Conn.

[21] Appl. No.: 108,608

[22] Filed: Dec. 31, 1979

[51] Int. Cl.[3] ..... H01H 85/50

[52] U.S. Cl. ..... 339/150 F; 337/213; 337/214

[58] Field of Search ..... 337/208, 214, 228, 213; 339/150 F, 196 R, 197 R, 159

[56] References Cited

U.S. PATENT DOCUMENTS

| | | | |
|---|---|---|---|
| 2,316,163 | 4/1943 | Hignutt | 339/196 R X |
| 2,813,174 | 11/1957 | Podell et al. | 337/214 X |
| 3,936,787 | 2/1976 | Ranzanigo | 337/213 X |

*Primary Examiner*—Eugene F. Desmond

*Attorney, Agent, or Firm*—Ronald S. Cornell; Israel Nissenbaum; Martin M. Glazer

[57] ABSTRACT

A receptacle for replaceably holding a replaceable fuse in an electrical circuit includes a forwardly inwardly tapered tubular member closed at its front end by a contact-defining metal cap and provided at its rear end with an internally threaded enlarged section, a contact-defining metal collar telescoping the rear of the tapered tube forward of the enlarged section and having a terminal tab projecting outwardly through an opening in the enlarged section. An externally threaded closure plug separably engages the tubular member threaded section and has in its front face a well whose axis is transversely offset from the plug axis and whose peripheral face is rearwardly inwardly tapered. A transversely crescent shaped wedge member projects forwardly from the well border and is integrally formed with the plug and has a tapered inside face coplanar with the well peripheral face.

11 Claims, 5 Drawing Figures

FUSE RECEPTACLE

BACKGROUND OF THE INVENTION

The present invention relates generally to improvements in electrical devices and it relates particularly to an improved receptacle for replacing housing and holding in an electrical circuit a cylindrical type fuse having metal cap terminals at opposite ends.

Many electrical devices such as electric motors, lamps, generators, transducers, batteries of various types, amplifiers and other electronic networks and the like are often provided as a safety measure with a replaceable fuse which is commonly of the cylindrical type provided with terminal-defining metal end caps. Many structures have been heretofore employed and proposed for replaceably housing such fuses and electrically engaging the end terminals thereof. However, these prior structures possess many drawbacks and disadvantages. They are generally relatively complex and expensive structures, often awkward, inconvenient and difficult to employ, of little versatility and adaptability and otherwise leave much to be desired.

SUMMARY OF THE INVENTION

It is a principal object of the present invention to provide an improved electrical receptacle device.

Another object of the present invention is to provide an improved receptacle for replaceably housing and coupling a fuse into an electrical network.

Still another object of the present invention is to provide an improved receptacle for replaceably housing and electrically coupling a fuse of cylindrical configuration having terminal-defining end metal caps.

A further object of the present invention is to provide a device of the above nature characterized by its simplicity, ruggedness, reliability, low cost, ease and convenience of use and high versatility and adaptability.

The above and other objects of the present invention will become apparent from a reading of the following description taken in conjunction with the accompanying drawings which illustrate a preferred embodiment thereof.

The device according to the present invention is a receptacle for replaceably holding a cylindrical electrical fuse and includes a body member having a longitudinal cavity of circular transverse cross-section, a first contact member located at the front end of the cavity and a second contact member defining collar telescoping the rear end of the cavity which is closed by a separable closure member having a wedge member projecting therefrom into the rear of the cavity adjacent the peripheral face thereof. A cylindrical fuse housed in the cavity is longitudinally urged by the closure member against the first contact and transversely urged by the wedge member against the second contact member.

In the preferred form of the improved device the body member is tubular and tapers inwardly from its rear toward its front end, the front end being closed by a metal cap defining the first contact member and being provided at its rear end with an internally threaded radially enlarged section, the collar telescoping the rear of the tapered tubular cavity forwardly of the enlarged section and having a radial tab projecting through an opening in the peripheral wall of the enlarged section. The closure member is an externally threaded plug having in its front face a well of circular cross-section whose axis is transversely offset from the longitudinal axis of the plug and which has a rearwardly inwardly tapered peripheral face. The plug screw engages the enlarged section thread. The wedge is integral with the plug and projects forwardly from the well border into the tapered cavity and has an inclined inside face coplanar with the well surface and a cylindrical outer face. The free edge of the wedge is convexly curved and the wedge extends only for a minor part of the periphery of the well.

The improved fuse-holding receptacle is simple to prefabricate, reliable, rugged, inexpensive, easy and convenient to use and of great versatility and adaptability.

DESCRIPTION OF THE PREFERRED EMBODIMENT

Figure 1:
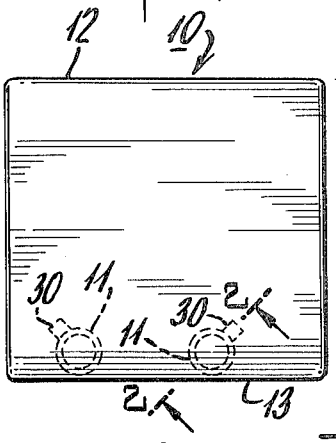
FIG. 1 is a plan view of a casing provided with a fuse receptacle embodying the present invention.
Figure 2:
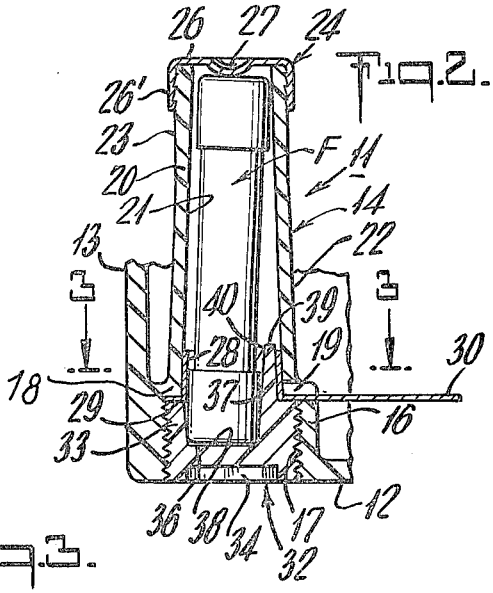
FIG. 2 is an enlarged sectional view taken along the line 2—2 in FIG. 1.
Figure 3:
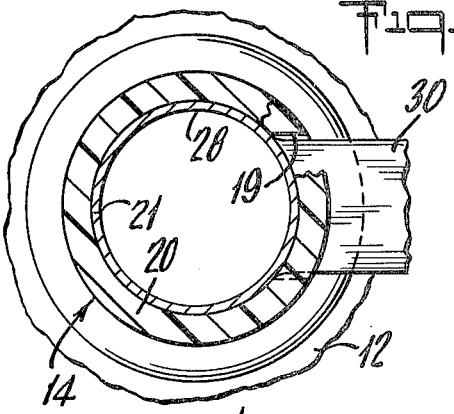
FIG. 3 is an enlarged sectional view taken along the line 3—3 in FIG. 2.
Figure 4:
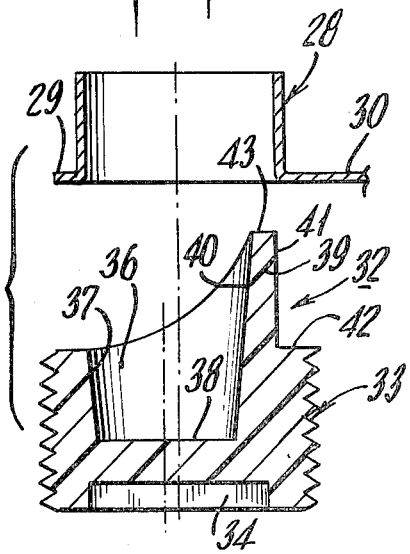
FIG. 4 is an exploded medial longitudinal sectional view of the collar contact and closure plug of the fuse receptacle.
Figure 5:
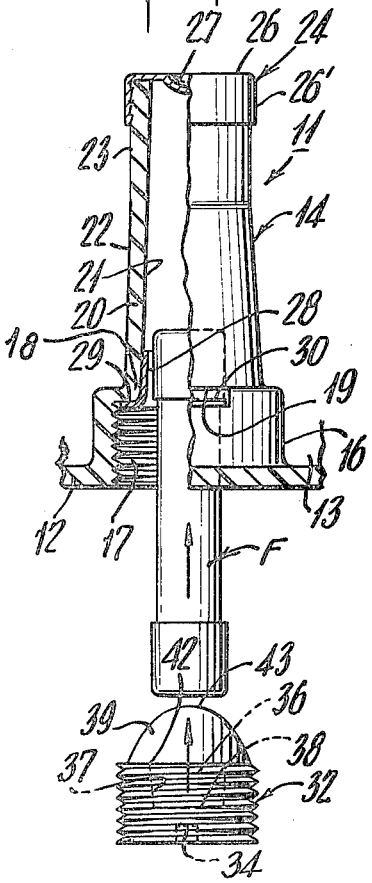
FIG. 5 is a front elevational view, partially in section of the fuse receptacle, with the closure plug and fuse shown in separated and partially withdrawn positions, respectfully.

Referring now to the drawings which illustrate a preferred embodiment of the present invention as applied to a battery case such as for a lithium or other primary battery, it being understood that it is applicable to other structures and devices, the reference numeral 10 generally designates the battery case and 11 designates the improved replaceable fuse receptacle. The receptacle 11 is advantageously employed with conventional replaceable electrical fuses of the cylindrical type as typified as 3AG and 4AG size fuses. The main body of receptacle 11 is preferably integrally formed with the case 10 of a synthetic organic polymeric resin by injection moulding or other suitable process, or of a thermosetting plastic of the phenolic type.

The case 10 includes a square base or end wall 12 and peripheral walls 13 projecting perpendicularly from the edges of end wall 12. The overall construction of case 10 depends on the use to which it is applied and may be as desired.

The receptacle 11 comprises a main tubular or hollow body member 14 including a cylindrical bottom or base wall 16 disposed adjacent and joined to a side wall 13 and projecting perpendicularly from base wall 12 and registering with a corresponding opening therein. Cylindrical wall 16 which defines a base section is internally threaded, as at 17, for the full length of wall 16 and terminates at its top in an inwardly directed peripheral flange 18 defining a downwardly facing annular shoulder. A radial portion of flange 18 is cut away to define an opening 19.

Projecting upwardly from the inner border of flange 18 and integrally formed therewith is an upwardly inwardly tapering tubular main section 20 of circular cross-section and coaxial with base wall 16 and terminating in a top end opening. The inside face 21 of main section 20 is conical and its lower outside face 22 is likewise conical and its upper outside face 23 is substantially cylindrical. The dimensions of the body member 14 depends on the dimensions of the fuse F which the receptacle 11 accommodates.

A first electrical contact defining member 24 closes the open top end of tubular section 20 and is in the form of a cap formed of metal and includes a circular top wall 26 resting on the top of tubular section 20 and a depending peripheral skirt wall 26 engaging and suitably secured or bonded to the upper border of upper outside face 23. Centrally formed in cap top wall 26 is a depending convex dimple 27.

Telescoping the lower or rear portion of main section 20 is a second electrical contact defining metal collar or ring 28 terminating at its bottom in an outwardly directed peripheral flange 29 which overlies the underface of flange 18. Integrally formed with flange 29 and projecting radially outwardly therefrom through opening 19 is a tab or tongue 30 which functions as a terminal or welding tab and to retain the ring 28 in its telescoping position within main section 20.

A receptacle closure plug 32 is formed of a synthetic organic polymeric resin and separably engages the receptacle base section 16. Closure plug 32 includes an externally threaded cylindrical body member 33 which rotatably screw engages the base section threaded interior face 17 and has a tool accommodating diametric slot 34 in its rear or outside end face. Formed in the front end face of body member 33 is a well 36 of circular transverse cross-section and with a central longitudinal axis transversely offset from the central longitudinal axis of cylindrical body member 33. The peripheral face 37 of well 36 is conical being rearwardly inwardly tapered, and terminates in a flat base 38.

Integrally formed with and projecting forwardly from the front end face of plug-body member 33 is an arcuate wedge member 39 extending only part way around well 36 and including inside and outside faces 40 and 41, respectively. The wedge inside face 40 is conical, tapering rearwardly inwardly and is coplanar with the well peripheral face 37 and the wedge outside face 41 is of arcuate transverse cross-section and coaxial with cylindrical body member 33. Wedge outside face 41 may be of a taper corresponding to that of main section inside face 21 and at its base is a diameter approximately that of the inside face of collar 28. A forwardly facing peripheral shoulder 42 on the front end of cylindrical body-member 33 separates wedge member 39 from the edge of body-member 33. The front end face 43 of wedge 39 is convexly curved and the opposite sides thereof converge with shoulder 42. The height of wedge 39 at its apex is slightly greater than the height of collar 28.

In the operation of the improved replaceable fuse receptacle 11 described above, the closure plug 32 is unscrewed and separated from the base member 16. A fuse F of proper size is inserted into tubular body-member 14 and the closure screw plug 32 reapplied to base member 16 in screw engagement with thread 17 and turned by means of a screw driver or other suitable tool to tighten it. The fuse F is inclined to the axis of body-member 14 to leave an enlarged space of crescent-shaped transverse cross-section between the relatively greater spaced confronting faces of body-member 14 and fuse F, the bottom end of fuse F resting on closure base 38. The wedge member is of similar transverse cross-section to the crescent-shaped space and with the tightening of closure plug 32, it advances upwardly to raise fuse F until its top terminal firmly engages dimple and to raise wedge member 39 whereby the conical face 40 thereof transversely urges the bottom terminal of fuse F into firm engagement with ring contact 28 completing the electrical circuit between the first and second contact members 24 and 28. When closure screw plug 32 is in its fully advanced position completing the circuit in the above manner, the collar flange 29 is sandwiched between shoulder 42 and flange 18. A fuse F may be replaced merely by unscrewing closure plug 32, replacing the fuse, and reapplying the screw plug as heretofore explained.

As modifications to the structure described above, it is possible that access to the fuse F within its receptacle 11 may be either internal or external to the casing of the equipment with which the fuse is incorporated and is designed to protect. Thus, whether the casing or receptable is within the general casing of the equipment or exterior to general casing of the equipment is a design feature to be made in accordance with the wishes of the manufacturer.

The housing 20 can be made with vertical ribs having openings therebetween, and does not have to be solid as shown in the drawings. Furthermore, the cap 26 may be secured to the housing 20 by means of a tight press-fit, or by means of teeth which are embedded into the plastic. Of course, if a thermosetting plastic is used, this type of joinder is not possible. Another method of joining the cap 26 to the housing 20 is to have external threads on top of the housing and internal threads along the inner walls of the skirt 26'.

There are occasions where the length of the fuse may vary by as much as 1/32 to 1/16 of an inch. In order to ensure a proper tight electrical contact fit between the various elements of the fuse, it is possible that the dimple 27 may be replaced by a downwardly extending finger made of spring steel or such other resilient metal. Thus, any slack because of a shortness of the fuse would be accommodated. It would also be possible to make the cap slightly shorter so that it is recessed from the outer walls 12 for a proper size fuse, and if the fuse is a little longer, the plug would then be flush with the outer walls of the housing.

It is also possible that the housing may be at various angles, other than vertical. In such instances, the fuse could be wedged within the frustoconical chamber of the plug to form a slight friction fit, and the plug itself, when removed, would carry the fuse with it.

While there has been described and illustrated a preferred embodiment of the present invention, it is apparent that numerous alterations, omissions and additions may be made without departing from the spirit thereof.

I claim:

1. A receptacle for replaceably holding a cylindrical fuse having top and bottom terminals comprising a body member having a cavity of circular transverse cross-section extending longitudinally from an open rear end to a front end, a first fixed electrical contact disposed at said cavity front end for making electrical contact with the top terminal of the fuse, a second fixed electrical contact defining ring telescoping said cavity proximate its rear end, said second fixed electrical contact adapted for making electrical contact with the bottom terminal of the fuse, a closure member releasably engaging said cavity rear end and a wedge member carried by and projecting forwardly of said closure member into said cavity and transversely offset from the central longitudinal axis thereof and having a forwardly outwardly inclined inside face, whereby on the engagement of said closure member with said cavity rear end the wedge member longitudinally urges the top terminal of the fuse into electrical contact with the first fixed electrical contact and simultaneously transversely urges the bottom terminal of the fuse into electrical contact with said second fixed electrical contact.

2. The fuse holding receptacle of claim 1 wherein the face of said cavity tapers forwardly inwardly.

3. The fuse holding receptacle of claim 1 wherein said closure member has a well formed in the front face thereof.

4. The fuse holding receptacle of claim 3 wherein said well has a rearwardly inwardly inclined peripheral surface.

5. The fuse holding receptacle of claim 3 wherein the longitudinal axis of said well is laterally offset from the longitudinal axis of said cavity.

6. The fuse holding receptacle of claim 4 wherein said wedge member has an inside face substantially coplanar with the face of said well.

7. The fuse holding receptacle of claim 1 wherein said cavity face is threaded at its rear end and said closure member comprises a threaded plug engaging said cavity threaded face.

8. The fuse holding receptacle of claim 1 wherein said body member comprises a forwardly tapering open end front main section and a coaxial radially enlarged internally threaded rear section, said first electrical contact includes a metal cap capping and affixed to the front end of said main section, said second electrical contact comprises a collar telescoping the rear end of said main section and said closure member comprises an externally threaded plug engaging said threaded rear section and having formed in its front face a well of circular transverse cross-section whose longitudinal axis is transversely offset from the longitudinal axis of said plug.

9. The fuse holding receptacle of claim 8 wherein said well peripheral face tapers rearwardly inwardly and said wedge member is integrally formed with said plug and extends partially along the border of said well and has an inside face coplanar with the peripheral face of said well.

10. The fuse holding receptacle of claim 8 wherein said front and rear sections are delineated by a rearwardly facing annular shoulder and said rear section has a side opening therein proximate said shoulder and said collar has an outwardly projecting peripheral flange along its rear edge underlying said shoulder and provided with an outwardly extending terminal tab projecting through said rear section side opening.

11. The fuse holding receptacle of claim 1, wherein said body member is formed as an integral part of a housing enclosing desired equipment.

* * * * *

UNITED STATES PATENT AND TRADEMARK OFFICE

CERTIFICATE OF CORRECTION

PATENT NO. : 4,299,435

DATED : November 10, 1981

INVENTOR(S) : Gordon E. Kaye

It is certified that error appears in the above–identified patent and that said Letters Patent are hereby corrected as shown below:

At Column 1, line 5 insert:

---This invention was made with Government support under Contract No. DAAB07-77-C-1805 awarded by the Department of the Army. The Government has certain rights in this invention.---

Signed and Sealed this

*Eighth* Day of *April 1986*

[SEAL]

*Attest:*

DONALD J. QUIGG

*Attesting Officer*

*Commissioner of Patents and Trademarks*